US006526626B1

(12) United States Patent
LoTufo

(10) Patent No.: US 6,526,626 B1
(45) Date of Patent: Mar. 4, 2003

(54) CARPET SAMPLE BOARD SPACERS

(76) Inventor: Robert J. LoTufo, 2710 Kanasita Dr., Hixson, TN (US) 37343

( * ) Notice: Subject to any disclaimer, the term of this patent is extended or adjusted under 35 U.S.C. 154(b) by 0 days.

(21) Appl. No.: 09/818,793

(22) Filed: Mar. 27, 2001

Related U.S. Application Data

(63) Continuation-in-part of application No. 09/334,785, filed on Jun. 16, 1999, now Pat. No. 6,223,390.

(51) Int. Cl.[7] ..... A47F 7/16; A44B 21/00
(52) U.S. Cl. ..... 16/110.1
(58) Field of Search ..... 24/457, 458; 16/110.1, 16/446, 443, 2.1; 40/723, 729; 211/163, 45, 47

(56) References Cited

U.S. PATENT DOCUMENTS 4,542,827 A * 9/1985 Pilzer ..... 206/483
5,069,586 A * 12/1991 Casey ..... 411/339
6,237,782 B1 * 5/2001 Hunn ..... 211/47

* cited by examiner

*Primary Examiner*—Robert J. Sandy
(74) *Attorney, Agent, or Firm*—Miller & Martin LLP

(57) ABSTRACT

Spacers for a carpet sample board are described comprising two pieces, each with an outer flange to cover the hole cut in the sample board. The carpet sample board includes at least one spacer to prevent boards arranged in a binder or carrier from rubbing against or flattening the fabric of carpet samples on subsequent boards. The spacers are typically attached to the board by the mating of male and female members, where a male member is placed on the top surface of the board and penetrates the board through an aperture in the board. The male member is then coupled by a female member on the opposite surface of the board.

20 Claims, 8 Drawing Sheets

CARPET SAMPLE BOARD SPACERS

PRIORITY

The present invention is a continuation-in-part of U.S. Ser. No. 09/334,785 filed Jun. 16, 1999, now U.S. Pat. No. 6,223,390.

FIELD OF THE INVENTION

The present invention relates to a handle for carpet sample boards and a spacer for separating the sample boards.

BACKGROUND OF THE INVENTION

In the carpet industry, it is necessary to show dealers and customers a wide variety of carpet samples due to the many different color, pattern, weight, yarn and tufting combinations that are available. One of the more popular methods of transporting and displaying carpet samples is by mounting the samples on a display board. These boards are typically eighteen inches wide and twenty-seven inches tall, made of one-fourth inch thick paper "chip board." The board is laminated with a glossy printed advertisement and carpet swatches are glued or otherwise affixed to it.

Typical display boards can weigh as much as, or even in excess of, ten pounds. Sample boards typically have an oval hole punched near their top center for use as a handle. This "handle hole" can have sharp edges, tends to fray, and in general has an unprofessional and unfinished look.

Other options for transporting and displaying carpet samples have generally included: placing carpet sample boards in binder systems so that multiple sample pages can be carried and displayed in a book-like format; or attaching elaborate handle systems to the sample boards.

This has created a second problem with typical display systems in that rubbing occurs between the backs of the display boards and the carpet samples. Because of the vigorous use of display systems carpet samples become worn and take on a "used" appearance that is undesirable to the trader of such goods. In addition, pressure on the carpet pile when sample boards are stacked on one another causes the carpet to mat unattractively.

The present invention adapts the standard sample chip board with handle hole at very little cost or additional weight to create a finished appearance, prevent fraying around the hole, and eliminate the sharp handle edges. In addition, the invention includes spacers that separate carpet samples from the backs of display boards when using the display boards in a binder display system. The spacers prevent the carpet pile from being pressed flat.

SUMMARY OF THE INVENTION

A handle for carpet sample boards is provided by the present invention which can be installed in new sample boards and used to retrofit existing boards. The handle is provided by two identical grommet halves which meet in the handle hole and secure the chip board between them. The grommet halves are joined by a simple mechanical interlocking mechanism such as a male and female plug system.

The grommet halves are elegantly and economically formed to provide a finished appearance to the sample boards, to provide a comfortable handhold with no sharp edges, and to prevent fraying of the edges of the handle.

A spacer for carpet sample boards is also provided by the present invention where the spacing unit consists of two spacers each having a male and female member. The male member rests on the top surface of the board and mates with a female member on the opposite bottom surface. The spacer is designed to extend to a height above the board sufficient to clear the exposed carpet sample. The spacer unit typically consists of two spacers of identical construction where both spacers have male and female members. In this arrangement the spacers are arranged lengthwise on the sample board with a first spacer mounted on the upper portion of the sample board and a second spacer mounted on the lower portion of the sample board. The two spacers are arranged such that the female and male members of each spacer mate with the female and male members of the opposing spacer. This is accomplished by aligning the post section of the male member through an aperture positioned in the sample board. The apertures are arranged such that each post section for the two spacers align with the complimentary female member of the opposite spacer. The top surface of each spacer protects the surface of the carpet sample by preventing contact between the carpet sample and the next sample board in the binder.

A second arrangement uses a spacer unit formed of two pieces, the first with a male plug and the second with a female plug. The first male spacer piece contains a top surface for protecting the exposed carpet and a post section that extends through an aperture in the sample board. The second female spacer piece contains a hole for mating with the male spacer and mates or friction fits snugly to lock the spacer unit. Again, the top surface of the first male spacer extends sufficiently above the sample board to protect the surface of the carpet. In both male and female spacer constructions the spacer may contain lateral flange. Typically the top surface and the post section of the male spacer are separated by a lateral support. This arrangement is particularly advantageous because the user may easily remove or place a spacer unit with only one male-female connection and thereby evoke spacer points. Spacers built in this fashion do not need to extend a significant portion of the width of the sample board. Instead, small spacer units may be placed at both sides of the board, and economics realized in the quantity of molding compound used in spacer manufacture per sample board.

DETAILED DESCRIPTION OF THE INVENTION

The preferred embodiment of the invention will be described in detail with reference to the drawings, wherein the referenced numerals represent like parts and assemblies throughout the views. Reference to the preferred embodiment does not limit the scope of the invention which is defined by the claims following.

Figure 8:
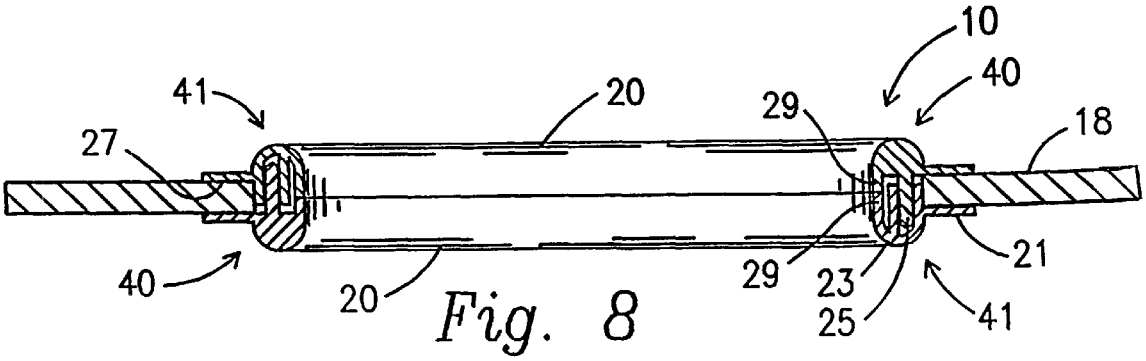
FIG. 8 is a cross sectional view of an assembled handle according to the present invention positioned through the hand hole of a sample board.
Figure 11:
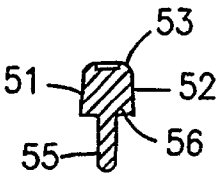
FIG. 11 is a cross sectional view of the lateral spacer taken along line A shown in FIG. 10.
Figure 12:
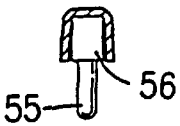
FIG. 12 is a cross sectional view of the lateral spacer taken along line B shown in FIG. 10.
Figure 13:
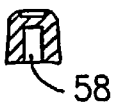
FIG. 13 is a cross sectional view of the lateral spacer taken along line C shown in FIG. 10.
Figure 9:
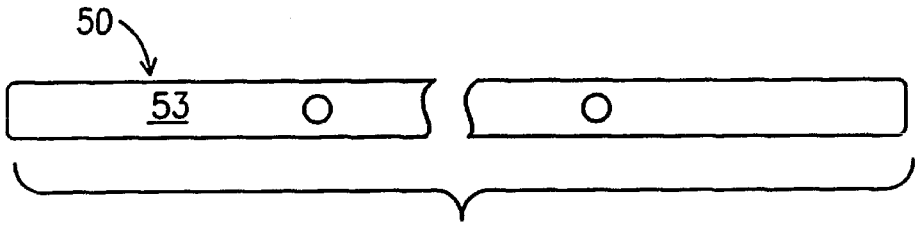
FIG. 9 is a top plan view of a lateral spacer used on carpet sample boards in conjunction with the handle of the present invention.
Figure 10:
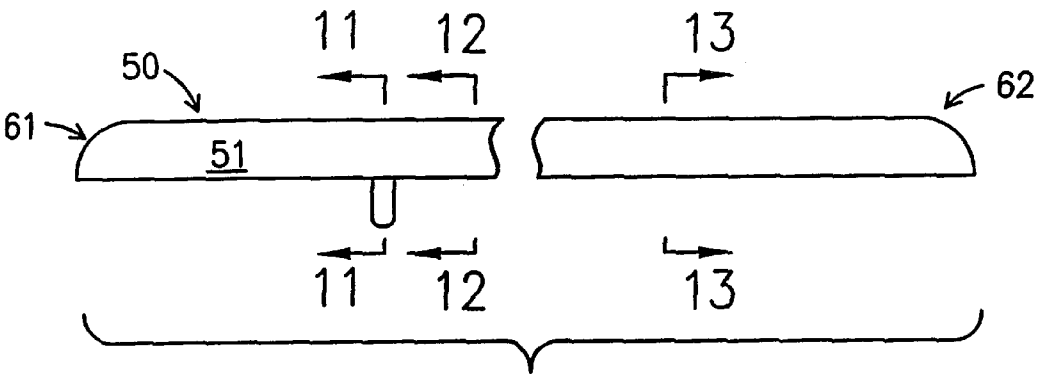
FIG. 10 is a front plan view of the lateral spacer of FIG. 9.
Figure 14:
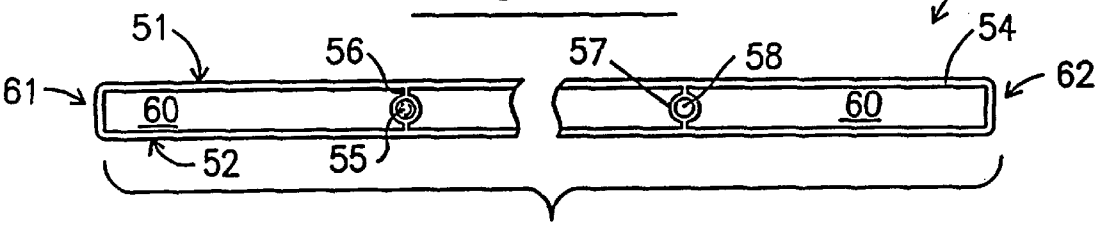
FIG. 14 is a bottom plan view of the lateral spacer of FIG. 9.

Referring initially to FIG. 8, across sectional view of handle 10 is shown comprised of two identical grommets 20. FIGS. 1 through 6 show the grommets 20 in complete detail.

Figure 1:
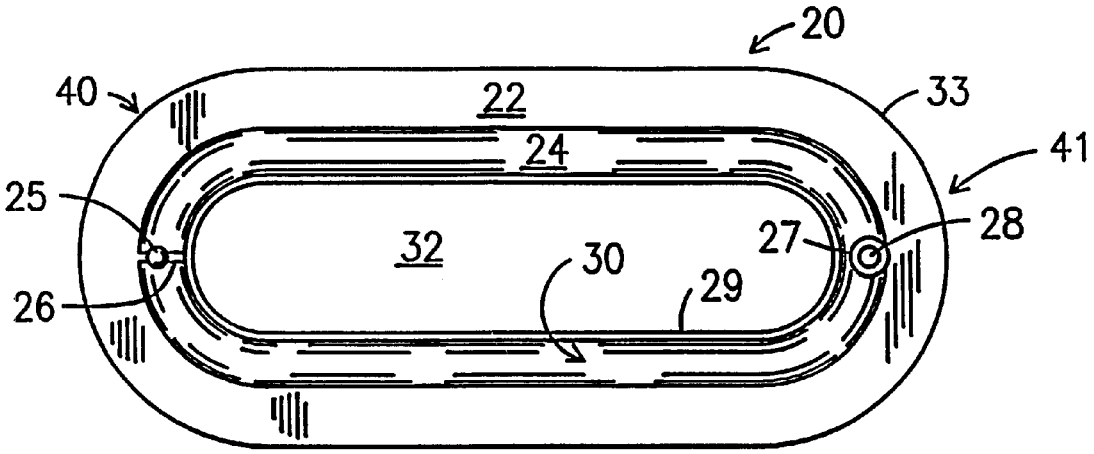
FIG. 1 is a bottom plan view of a grommet which comprises a part of the handle of the present invention.

FIG. 1 is a bottom plan view of a grommet 20. It will be seen that grommet 20 is comprised of a flange with bottom surface 22 and perimeter 33. Interior of bottom flange surface is a concave arcuate surface 24 which terminates in lip 29. Within the arcuate surface 24 and lip is defined a hand opening 32. The grommet is preferably manufactured of injection molded plastic such as high impact polystyrene in a color that will not clash with the carpet sample boards, black and white being the preferred colors. The typical thickness of the flange and arcuate portions is about 0.05 inches. The hand opening 32 is preferably almost one inch in height and almost four inches in length. The concavity of arcuate surface 24 generally results in defining channel 30 except for a male plug, such as post 25, at a first end 40 of the grommet 20 and a female plug, such as cylinder 27 defining opening 28, at an opposite second end 41 of grommet 20. In the illustrated construction, a solid wall 26 provides additional support to post 25.

Figure 2:
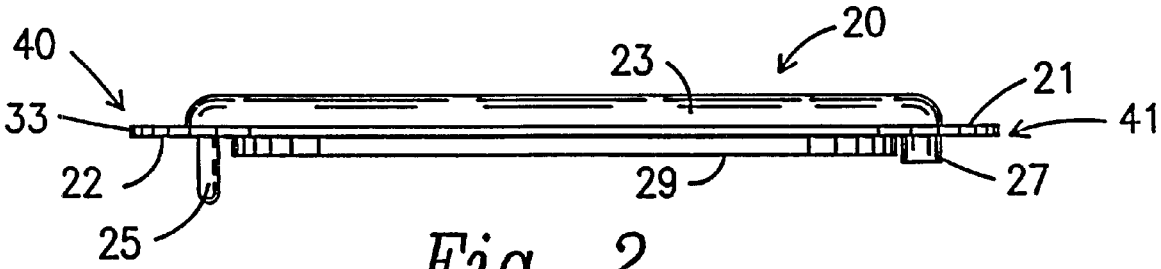
FIG. 2 is a front plan view of the grommet of FIG. 1.

FIG. 2 shows a front view of grommet 20 and more clearly depicts post 25 which extends for approximately 0.4 inches below the bottom surface 22 of the flange area. FIG. 2 also shows the top arcuate surface 23 which extends approximately 0.3 inches above the top surface 21 of the flange defined within perimeter 33. The interior lip 29 is shown extending about 0.15 inches beneath the bottom side 21 of the flange.

Figure 3:
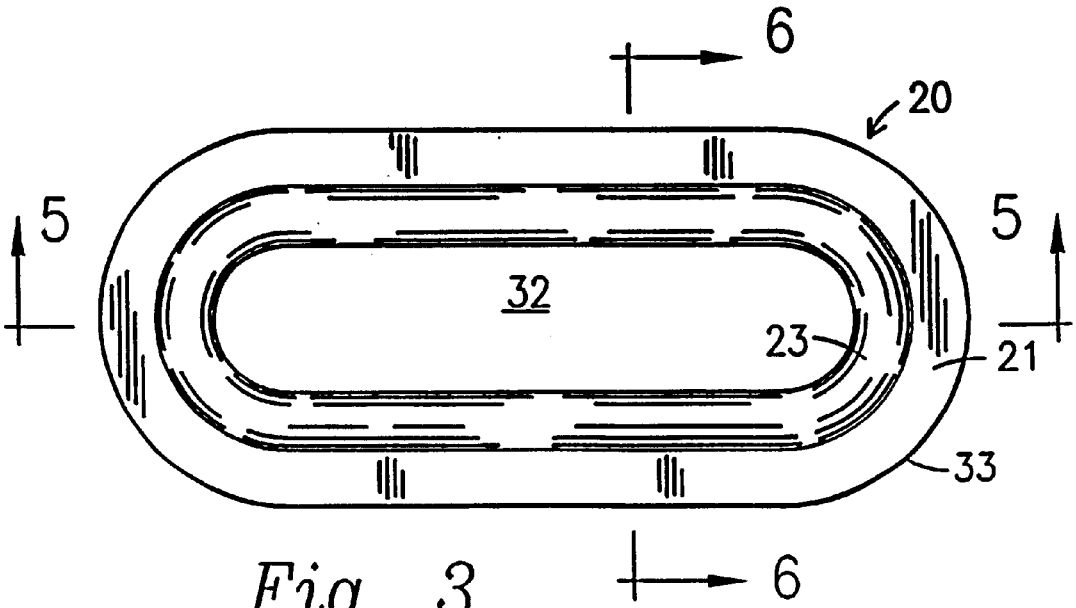
FIG. 3 is a top plan view of the grommet of FIG. 1.

FIG. 3 is a top view of grommet 20 showing the top flange surface 21 and the top arcuate surface 23 within which is defined the hand opening 32.

Figure 5:
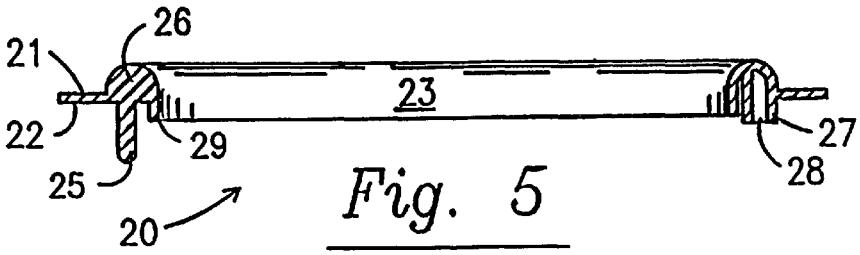
FIG. 5 is a cross sectional view of the grommet of FIG. 1 taken along line A shown in FIG. 3.
Figure 4:
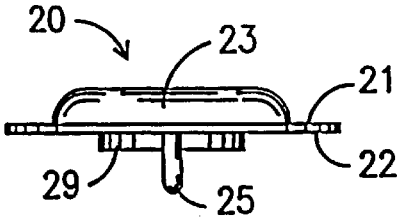
FIG. 4 is a left side plan view of the grommet of FIG. 1.
Figure 6:
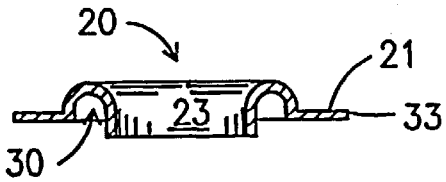
FIG. 6 is a cross sectional view of the grommet of FIG. 1 taken along line B shown in FIG. 3.

FIG. 4 provides a side view. FIG. 5 is a cross sectional view taken along line 5—5 shown in FIG. 3. Because this cross section intersects the support wall 26, channel 30 is not clearly visible. However, in FIG. 6, a sectional view taken along line 6—6 of FIG. 3 channel 30 can be clearly seen.

Figure 7:
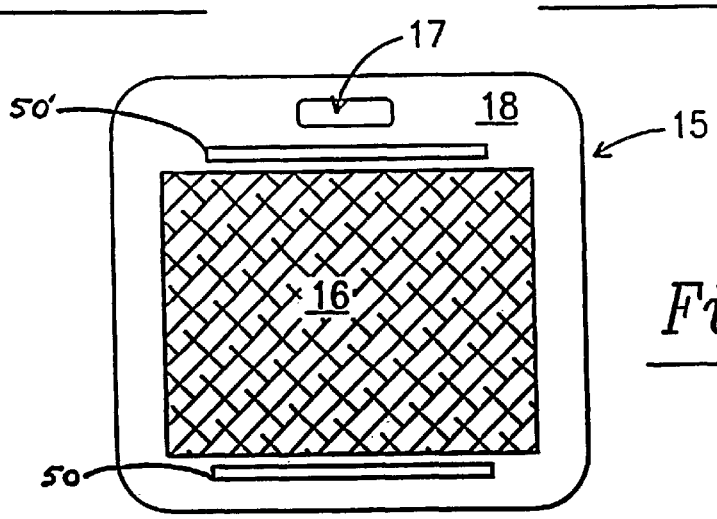
FIG. 7 is a top plan view of a carpet sample board with lateral spacers showing an unfinished handhold.

FIG. 7 demonstrates a typical carpet sample board 15 with lateral spacers 50, 50, comprised of chip board 18, glued on carpet sample 16 and hand hole 17. FIG. 8 shows the installation of a handle 10 comprised of grommet halves 20 in hand hole 17. It will be seen that the first end 40 containing a male plug such as post 25 of the bottom grommet 20 is positioned to interfit with the second end 41 containing a female plug such as hollow cylinder 27 of the top grommet. Both the lip portions 29 and the connecting post and cylinder structures 25, 27 are positioned within the hand hole 17 of chip board 18. The bottom flange surfaces 22 sandwich the chip board 18 and cover all of the hand hole 17 punched through the board. The result is a comfortable handgrip defined by outer arcuate surfaces 23 of the mated grommets 20. The result is to protect users' hands from sharp edges of the chip board 18, to prevent fraying of edges of the hand hole 17, and for the flange surfaces 21 to cover any irregularities in the hand hole 17.

FIGS. 9–14 disclose a lateral spacer 50 that is advantageously used in connection with carpet sample boards as shown in FIG. 7. These lateral spacers 50 are also advantageously injection molded of high impact polystyrene and are preferably somewhat shorter than the width of the carpet sample boards upon which they are to be used. A typical spacer 50 length would be about fifteen inches. Lateral spacers 50 come in a variety of heights depending upon the carpet samples with which they are intended to be used. A typical spacer height is about one-half (½) inch, while a very thin carpet might suggest the use of a shorter spacer 50 and a deep carpet might suggest the use of a taller spacer 50. Spacers 50 have a top surface 53, a first side 51 and an opposed side 52. Spacers 50 also have a bottom surface 54 which advantageously defines a hollow channel 60. Within the channel 60 may be lateral supports to give spacer 50 structural stability. Preferably, one such support may be combined with a male plug such as post 55, the solid section 56 near the post 55 comprising the lateral support structure. A support may also be combined with hollow cylinder 57 forming a hole 58 which acts as a female plug. In the spacer 50 shown the male plug is located toward a first end 61 and the female plug is toward the second end 62.

Figure 15:
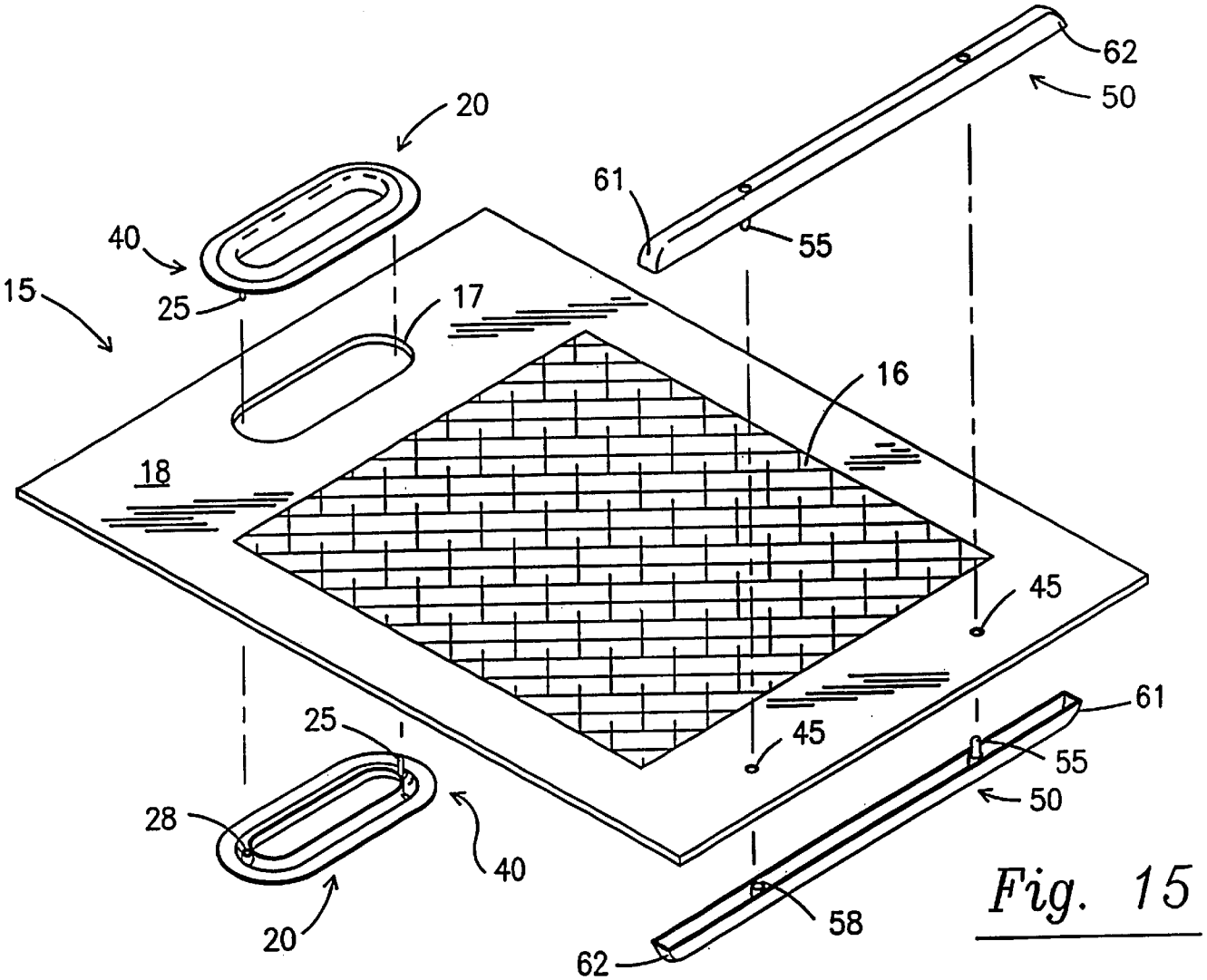
FIG. 15 is an exploded view of a carpet sample board utilizing the present handle invention and a lower lateral spacer.

FIG. 15 shows an exploded view of a carpet sample board according to the present invention. A chip board 18 is shown with hand hole 17 and apertures 45 for spacers 50. A carpet sample 16 is affixed to face of chip board 18. A pair of grommets 20 are mated through hand hole 17 with the first ends 40 of the respective grommets 20 rotated 180 degrees from one another so that the male post 25 of the upper grommet 20 is received in the hole 28 of the lower grommet 20 through the hand hole 17. Similarly, the lateral upper spacer 50 is oriented with its first end 61 and plug 55 opposite the second end 62 and hole 58 of the lower spacer 50. In this fashion the post 55 of each lateral spacer 50 is received in the hole 58 of its paired spacer 50 and the two lateral spacers are thereby joined about the chip board 18 to form an easily handled carpet sample board 15 with spacer 50 to protect carpet sample 16 from undue wear.

Figure 16:
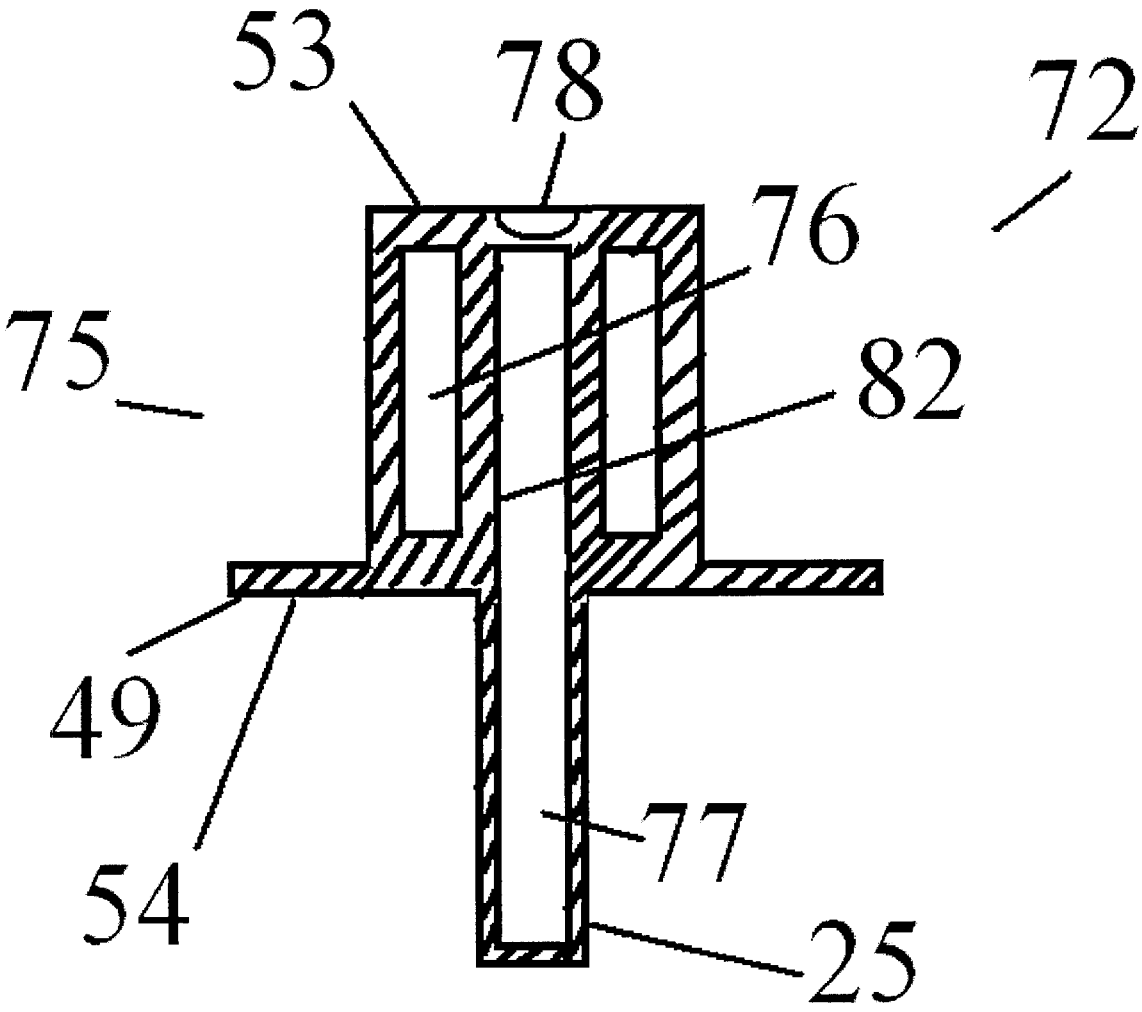
FIG. 16 is a cross sectional view of the male portion of a point spacer.
Figure 17:
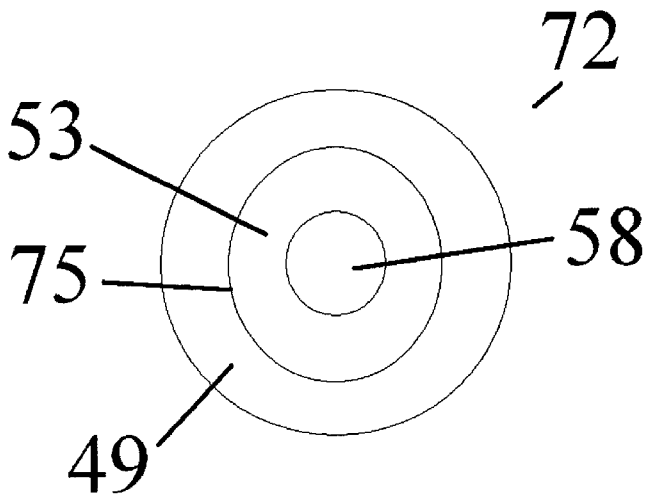
FIG. 17 is a bottom plan view of the male portion of FIG. 14.

FIGS. 16–19 disclose an alternative to the lateral spacer 50 embodiment. This alternative, utilizes point spacer units 70. Each point spacer unit 70 comprises a first male piece 72 and a second female piece 74. As shown in FIG. 16, piece 72 has a cap portion formed by cylindrical wall 75 and top surface 53 with dimple 78. A flange 49 protrudes from the bottom of cylindrical outer wall 75. The cylindrical outer wall 78 typically extends to a height of between ⅜ and 1" above the flange 49. The bottom surface 54 of flange 49 is adopted to rest on board 18 and both to cover any irregularities in aperture 45, shown in FIG. 20, and to stabilize the spacer unit 70 on the board 18. Male piece 72 also has a male plug such as post 25 formed by cylindrical post wall 82 which encircles cylindrical channel 77 and extends downward substantially from the top surface 53 through the entire length of the post 25. The post 25 will typically protrude between about one half to one inch as the post 25 must accommodate both the thickness of board 18 and also have sufficient additional length to be received within the female piece 74. To avoid the unnecessary consumption of molding material, there is an empty circular channel 76 between cylindrical outer wall 75 and post wall 82.

Figure 19:
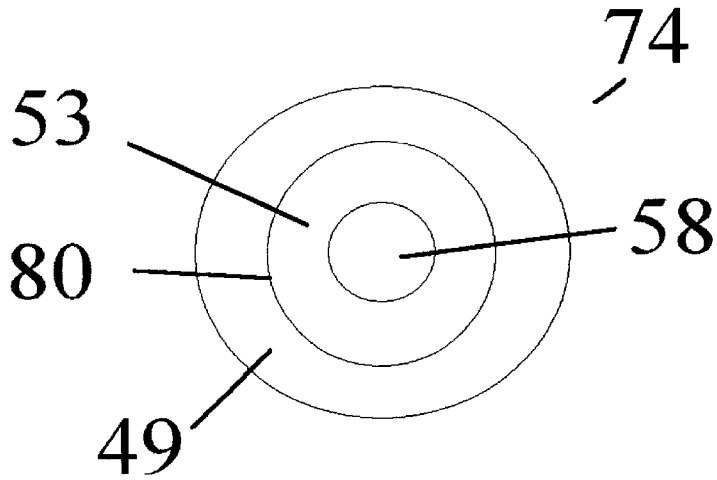
FIG. 19 is a bottom plan view of the female portion of FIG. 18.
Figure 18:
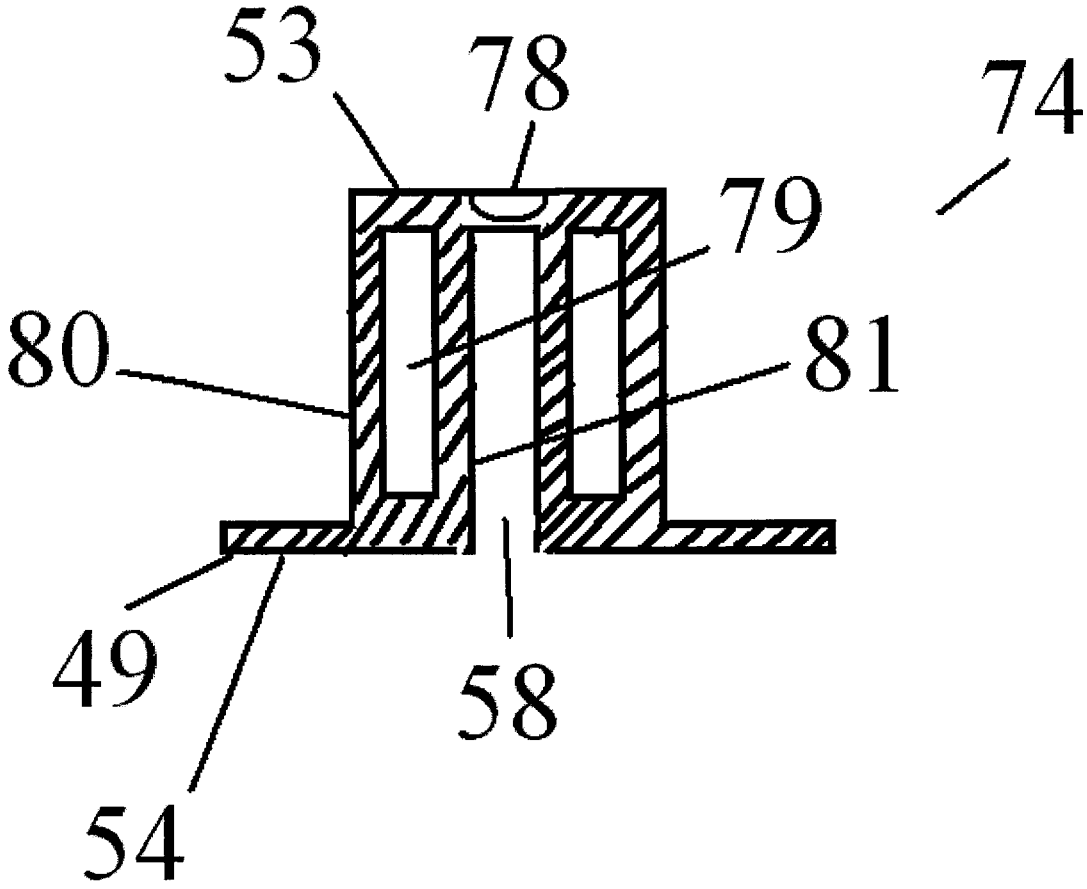
FIG. 18 is a cross sectional view of the female portion of a point spacer.

Second female piece 74, shown in FIGS. 18 and 19, is similarly constructed with a cap portion of about ⅜ to 1" in height formed by cylindrical outer wall 80 and top surface 53, again with a molding dimple 78. A flange 49 protrudes from the bottom of cylindrical outer wall 80. The bottom surface 54 of flange 49 is adopted to be placed on a top or bottom surface of board 18, shown in FIG. 20. A female plug in the form of hole 58 is defined by cylindrical inner wall 81 extending substantially between the bottom surface 54 of flange 49 to the top surface 53 of the cap portion. Between outer wall 80 and inner wall 81 is defined as circular void 79, which results in the use of less molding compound and lighter weight than would a solid component.

Figure 20:
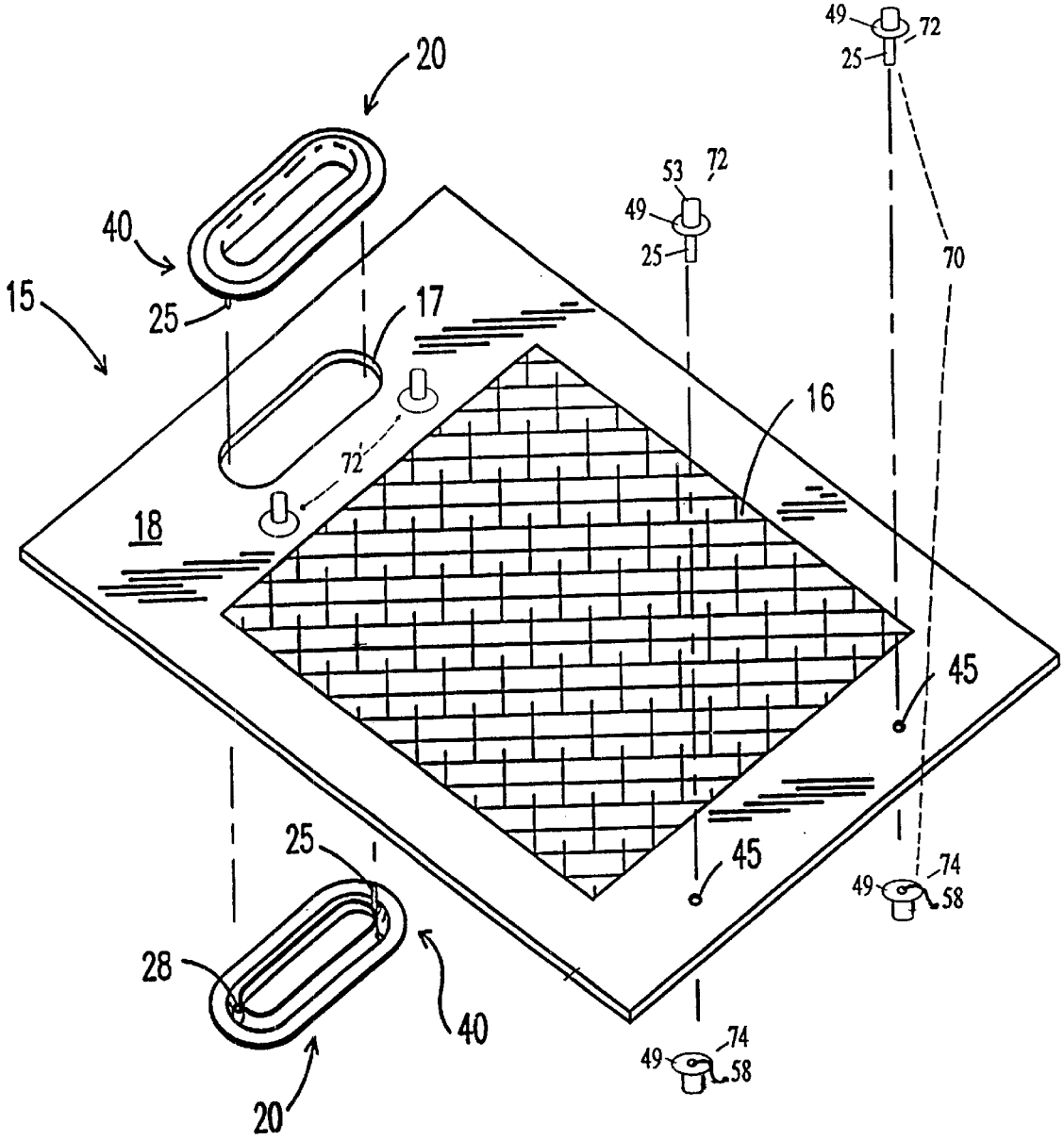
FIG. 20 is an exploded view of a carpet sample board utilizing point spacer units and the type illustrated in FIGS. 16–19.

FIG. 20 shows a partially exploded view of a carpet sample board 15 utilizing point spacer units 70. Carpet sample board 15 comprises a chip board 18 with optional hand hole 17 and openings 45 for spacer units 70. A carpet sample 16 is affixed to the face of chip board 18. A pair of grommets 20 may be mated through hand hole 17 as previously described in connection with FIG. 15.

Spacer units 70 may be utilized on boards 18 without grommets 20 or even a hand hole 17 in appropriate instances. At the end of sample board 15 adjacent to hand hole 17, the first male pieces 72' of spacer units 70 are shown in their fully mounted position. At the opposite end 19 of sample board 15, two spacer units are shown in an exploded view. It can be seen that first male spacer pieces 72 are lowered toward sample board 15 so that the posts 25 are received through apertures 45 in board 18 and bottom flange surfaces 54 are flush with a first surface of board 18. Second female spacer pieces 74 are then raised so that posts 25 are mated in holes 58 and bottom flange surfaces 54 of spacer pieces 74 are flush with a second opposite surface of board 18. The fit between the male plug such as post 25 and female plug such as hole 58 is sufficiently snug or locking so that the two pieces 72, 74 of point spacer units 70 remain in position on board 18. Preferably a pair of point spacer units 70 are mounted at least proximate the bottom edge of board 18. Especially in the absence of a handle spacer such as grommets 20, a second pair of spacer units 70 may also be effectively utilized along the upper edge of board 18.

It will be obvious to those skilled in the art that various changes may be made without departing from the scope and spirit of the invention, and the invention is not to be considered limited to what is shown in the drawings and described in the specifications.

I claim:

1. A carpet sample board comprising:

(a) a handle;

(b) a board having a top surface and an opposite bottom surface, an upper portion and a lower portion and at least one aperture passing between said top and bottom surfaces in the lower portion;

(c) a carpet sample of predetermined depth affixed to the top surface of the sample board between the upper portion and at least one aperture;

(d) a first spacer mounted on the top surface of the board, said spacer having a bottom surface with a male plug extending into at least one aperture and having a top surface extending to a height above the board; and (e) a second spacer mounted on the bottom surface of the board having a female plug mated with the male plug of the first spacer.

2. The carpet sample board of claim 1 wherein the first and second spacers are of identical construction.

3. The carpet sample board of claim 1 wherein the top surface of the first spacer extends to a height above the board approximate to the predetermined depth of the carpet sample.

4. The carpet sample board of claim 1 wherein the top surface of the first spacer extends to a height of about one-half inch.

5. The carpet sample board of claim 1 wherein the first spacer has a length of about fifteen inches.

6. The carpet sample board of claim 1 wherein the bottom surface of the first spacer defines a hollow channel.

7. The carpet sample board of claim 6 wherein the hollow channel of the first spacer includes at least one lateral support.

8. The carpet sample board of claim 7 wherein the male plug of the first spacer is combined with at least one lateral support.

9. The carpet sample board of claim 1 further comprising:

(f) at least one aperture passing between the top and bottom surfaces of the board in the upper portion;

(g) a third spacer mounted on the top surface of the board, said spacer having a bottom surface with a male plug extending into at least one aperture and having a top surface extending to a height above the board; and (h) a fourth spacer mounted on the bottom surface of the board having a female plug mated with the male plug of the third spacer.

10. A carpet sample board comprising:

(a) a board having a top surface and an opposite bottom surface, an upper portion and a lower portion and at least one aperture passing between said top and bottom surfaces in the lower portion;

(b) a carpet sample of predetermined depth affixed to the top surface of the sample board between the upper portion and at least one aperture;

(c) a first spacer mounted on the top surface of the board, said spacer having a bottom surface with a male plug extending into at least one aperture and having a top surface extending to a height above the board and wherein said male plug contains a post section joined with a lateral support; and (d) a second spacer mounted on the bottom surface of the board having a female plug mated with the male plug of the first spacers said female plug having a lateral support defining a hole for receiving said post.

11. The carpet plug apparatus of claim 1 wherein the male plug and the female plug are mated by friction fitting.

12. A carpet sample board comprising:

(a) a handle;

(b) a board having a top surface and an opposite bottom surface, an upper portion and a lower portion and at least one aperture passing between said top and bottom surfaces in the lower portion;

(c) a carpet sample of predetermined depth affixed to the top surface of the sample board between the upper portion and at least one aperture;

(d) at least one spacer unit having a first male spacer piece and a second female spacer piece, the male piece being mounted on a first surface of the board, and having a male plug extending through said aperture and having a top surface extending to a height above the board; and (e) said second female piece on the opposite surface of the board, having a female plug section mated with the male plug of the first male spacer piece.

13. The carpet sample board of claim 12 wherein the top surface of the male spacer piece extends to a height above the board approximate to the predetermined depth of the carpet sample.

14. The carpet sample board of claim 12 wherein the top surface of the male spacer piece extends to a height of about one-half inch.

15. A carpet sample board comprising:

(a) a board having a top surface and an opposite bottom surface, an upper portion and a lower portion and at least one aperture passing between said top and bottom surfaces in the lower portion;

(b) a carpet sample of predetermined depth affixed to the top surface of the sample board between the upper portion and at least one aperture;

(c) at least one spacer unit having a first male spacer piece and a second female spacer piece, the male piece being mounted on a first surface of the board, and having a male plug extending through said aperture and having a circular top surface extending to a height above the board;

(d) said second female piece on the opposite surface of the board, having a female plug section mated with the male plug of the first male spacer piece;

wherein the top surface of the male spacer piece has a diameter of between about three eights inch and one inch.

16. The carpet sample board of claim 12 wherein the male spacer piece comprises a cap portion supporting the top surface.

17. A carpet sample board comprising:

(a) board having a top surface and an opposite bottom surface, an upper portion and a lower portion and at least one aperture passing between said top and bottom surfaces in the lower portion;

(b) a carpet sample of predetermined depth affixed to the top surface of the sample board between the upper portion and at least one aperture;

(c) at least one spacer unit having a first male spacer piece and a second female spacer piece, the male spacer piece being mounted on a first surface of the board, and having (i) a male plug extending through said aperture, (ii) a top surface extending to a height above the board, (iii) a cap portion supporting the top surface, and (iv) a cap portion supporting the top surface; and (d) said second female piece on the opposite surface of the board, having a female plug section mated with the male plug of the first male spacer piece.

18. The carpet sample board of claim 12 wherein the female plug section comprises an inner cylindrical wall defining a hole.

19. A carpet sample board comprising:

(a) a board having a top surface and an opposite bottom surface, an upper portion and a lower portion and at least one aperture passing between said top and bottom surfaces in the lower portion;

(b) a carpet sample of predetermined depth affixed to the top surface of the sample board between the upper portion and at least one aperture;

(c) at least one spacer unit having a first male spacer piece and a second female spacer piece;

(d) said first male spacer piece having a post extending through the at least one aperture, a flange extending perpendicular to said post and resting on a first of said top and bottom surfaces of said board, and a cap portion having a top surface said cap portion extending substantially perpendicular from the flange in a direction opposite the post;

(e) said second female spacer piece having a hole extending into a cap portion and receiving the post of the first male spacer piece, and a flange extending perpendicular to said post and resting on the opposite of said top and bottom surfaces of said board from the flange of the first male spacer piece.

20. The carpet sample board of claim 19 wherein the second female spacer has:

(a) an outer wall and a top surface comprising the cap portion;

(b) a cylindrical inner wall extending from the flange into the cap portion defining the hole; and (c) a circular void between said inner and outer walls extending from the flange toward the top surface.

* * * * *